United States Patent [19]

Rupe

[11] 4,261,311

[45] Apr. 14, 1981

[54] ENGINE INTAKE BIFURCATION APPARATUS

[76] Inventor: Melvin E. Rupe, 11331 Rolling Hills Dr., El Cajon, Calif. 92020

[21] Appl. No.: 53,297

[22] Filed: Jun. 29, 1979

[51] Int. Cl.[3] ..... F02D 17/02

[52] U.S. Cl. ..... 123/198 F; 123/198 R; 261/23 A

[58] Field of Search ..... 123/198 F, 198 DB, 198 R, 123/DIG. 6, DIG. 7; 261/23 A

[56] References Cited

U.S. PATENT DOCUMENTS

| | | | |
|---|---|---|---|
| 2,318,008 | 5/1943 | Morris | 261/23 A |
| 3,523,680 | 8/1970 | Bartholomew | 261/23 A |
| 3,549,132 | 12/1970 | Haase | 261/23 A |
| 3,678,911 | 7/1972 | Soubis | 123/198 F |
| 3,742,922 | 7/1973 | Hisatomi et al. | 261/23 A |
| 4,019,479 | 4/1977 | Garabedian | 123/198 F |
| 4,103,657 | 8/1978 | Minami | 261/23 A |
| 4,135,485 | 1/1979 | Loyd, Jr. | 123/198 F |
| 4,207,856 | 6/1980 | Sugasawa et al. | 123/198 F |

*Primary Examiner*—P. S. Lall

*Attorney, Agent, or Firm*—Ralph S. Branscomb

[57] ABSTRACT

The invention is an apparatus which is mountable to the two-barrel fuel mixture intake of an internal combustion engine, ordinarily eight cylinder, wherein the two intake barrels are covered with a special plenum which replaces the ordinary carburetor, this plenum having a central septum dividing it into two chambers, one of which communicates separately with each of the intake barrels, and each chamber mounting a separate carburetor with a separate fuel input, there being separately controlled valves in the fuel input lines of the two carburetors so that by cutting the fuel off to one carburetor, half of the cylinders become inoperative thus saving fuel. An opening is provided in the septum which is valved to open when it is desired to run all eight cylinders to insure pressure equalization in the intakes for all cylinders.

6 Claims, 7 Drawing Figures

ENGINE INTAKE BIFURCATION APPARATUS

BACKGROUND OF THE INVENTION

The present invention is in the field of energy-saving devices and paticularly relates to a means for eliminating half of the cylinders of an internal combustion engine temporarily to conserve fuel.

It is a well known fact that most large engines, especially the V-8 engines, do from time to time require a large portion of their power to be delivered, such as during acceleration, going uphill or pulling a heavy load. However, it is equally well known that these large engines consume fuel at a relatively high rate and that such fuel consumption is unnecessary for the great majority of the time during which the vehicle is driven. On the open highway, crusing within the legal speed limit of 55 miles per hour, there is probably no vehicle that requires the use of all eight cylinders in a V-8 engine in order to maintain speed. However, all cylinders are still pumping and thus consuming fuel at a high rate.

Ideally, some structure or apparatus should be provided whereby half of the engine cylinders could be rendered inoperative most of the time, with the capability of operating all eight cylinders so that the operator would have in effect two four cylinder engines which could be operated singly or together.

SUMMARY OF THE INVENTION

The present invention accommodates the above-stated need by providing a system which in one of several ways can render four of the eight cylinders of a V-8 engine inoperative by cutting off their fuel supply. This result is implemented by a special plenum which fits over the existing two-barrel intake of the engine and has an internal septum dividing the plenum into two chambers, one of which communicates separately to each of the two intake barrels. Connected to the plenum separately and atop each of the separate chambers are a pair of carburetors which also have separate fuel intake lines with control valves therein. These valves are controlled in one of three different ways. First, a straight manual control can be used. Second, a solenoid-operated electrical system with manual controls in the operating compartment can be implemented, and third, a semi-automatic system in which the particular set of four cylinders which are operating at any one time is alternated every time the engine is started so that the wear is even on both sets of cylinders.

In all the implementations, an optional opening in the septum is provided and incorporates a valve closure to permit opening of the septum to equalize the pressure in both halves of the plenum when the engine is operating in its eight cylinder mode.

DETAILED DESCRIPTION OF THE PREFERRED EMBODIMENTS

Figure 1:
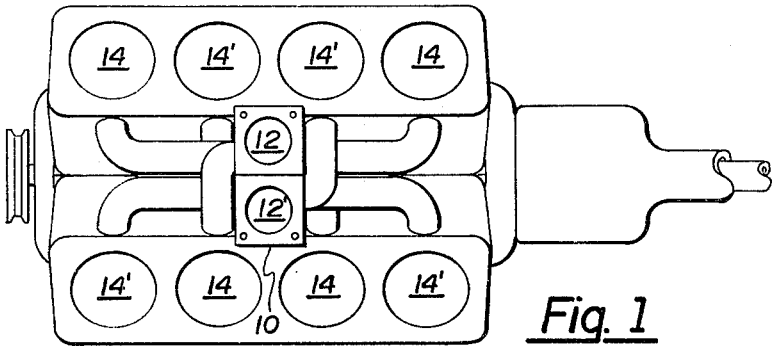
FIG. 1 is a top diagrammatic elevation of an engine with the carburetor removed.
Figure 2:
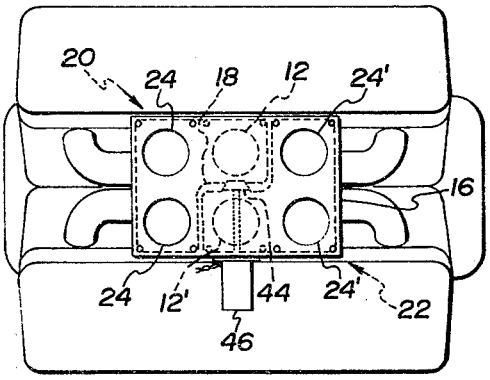
FIG. 2 is a top elevation view of the engine of FIG. 1 having the plenum thereon with the interior structure thereof shown in phantom.

A typical eight cylinder engine is diagrammatically illustrated in FIGS. 1 and 2 wherein carburetor mount 10 is provided with two barrels 12 and 12' which feed the cylinders, diagrammatically indicated at 14 and 14'. Each of the intake barrels 12 and 12' feeds four cylinders and the cylinders each barrel feeds are staggered from the other intake feeds as indicated by the cylinders 14 and cylinders 14', so that in the event one barrel becomes inoperative the engine still runs more or less smoothly.

The instant invention incorporates a plenum 16 which mounts directly atop the mount 10. The plenum has a central septum 18 which divides the plenum into two chambers, a first chamber 20 and a second chamber 22. Each chamber communicates separately with one of the two intake barrels 12 or 12' and does not communicate with the other chamber.

Figure 6:
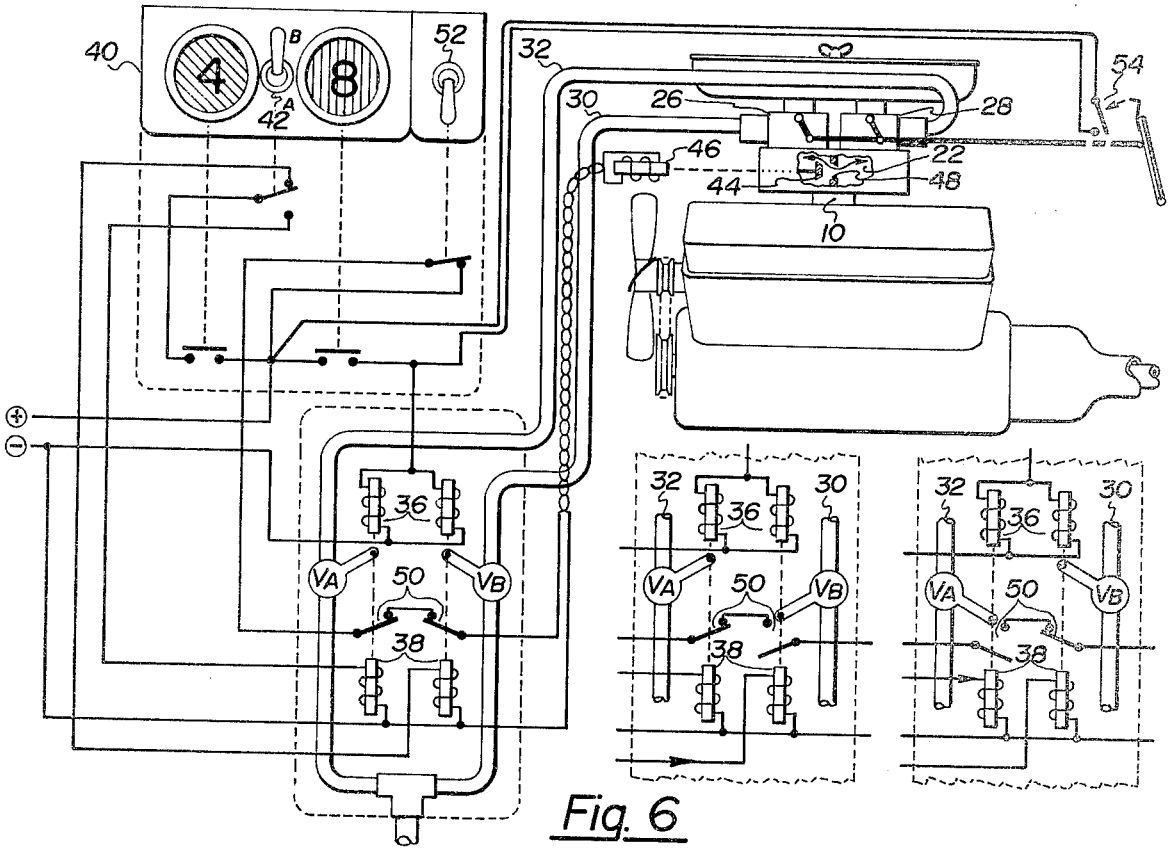
FIG. 6 is a schematic diagram of a manually operated electronically implemented circuit.
Figure 7:
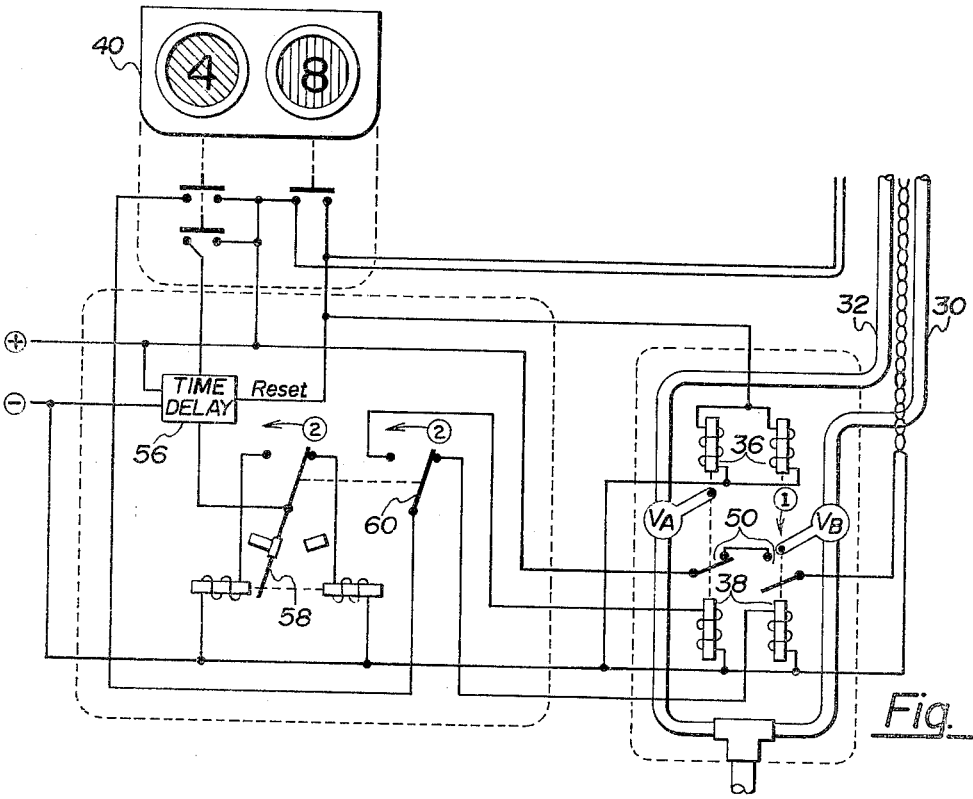
FIG. 7 is a schematic of a semi-automatic electronic solenoidal implementation of the control system wherein the four-cylinder groups are automatically alternatively actuated.

Two pairs of ports 24 and 24' are provided in the top of the plenum for each of the chambers 20 and 22 so that two carburetors 26 and 28, and shown in FIG. 6, can be mounted over the respective chambers. Each of the carburetors has a separate fuel supply line shown at 30 and 32 and each of these fuel supply lines is controlled respectively by valves Va and Vb. Actually in its most rudimentary embodiment, only one of the valves need be provided, so that a shut off capability is provided to half the cylinders, although of course the cylinders would not be capable of alternately operating one half and then the other to insure even wearing of the engine.

In any event, the two valves Va and Vb, or only one of them, could be controlled by a manual push-pull knob indicated at 34.

Turning to the more complex implementations of the apparatus, FIG. 6 discloses valves Va and Vb being controlled by an upper pair of "on" solenoids 36 and a lower pair of "off" solenoids 38. These solenoids actuate the valves as follows.

It can be seen that the control panel 40 has a touch switch with "4" displayed thereon and a similar switch displaying "8". The operator must make the threshold decision as to whether at that particular time he wishes to operate on eight or four cylinders and depress the appropriate switch.

If the "8" switch is depressed, it can be seen that the solenoids 36 are both energized, turning both valves Va and Vb to the open position. If instead of pressing the "8" button, the "4" was depressed, the solenoids 36 remain inoperative and one of the solenoid 38 is actuated, depending upon whether the toggle switch 42 is in the "a" or "b" position. The effect of operating one of the solenoids 38 is of course to shut the respective one of the fuel line valves, thus cutting off the four cylinders operated by the carburetor in question. The two modes of four cylinder operation are diagrammatically illustrated in the inserts in the lower right of FIG. 6.

Figure 3:
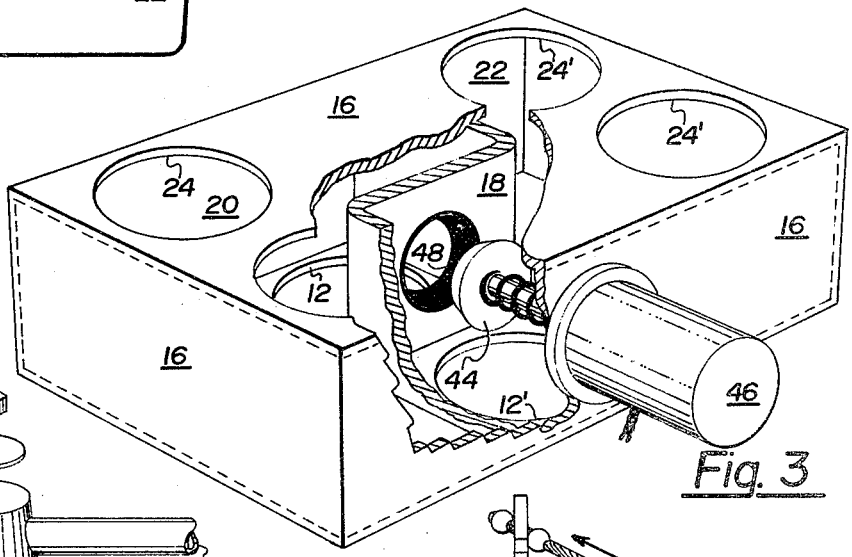
FIG. 3 is a perspective view of the plenum having portions cut away illustrating the operation of the plenum sealing valve.
Figure 5:
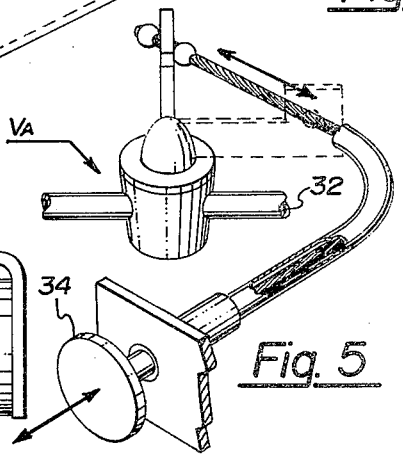
FIG. 5 is a an illustration of a manual control for use with the valve shown in FIG. 4.

Two other features of the apparatus as diagramed in FIG. 5 include the septum bypass valve shown at 44 which is diagrammatically shown in its physical implementation in FIG. 3. This valve, which could also be manually operated, as shown in the embodiment of FIG. 6 utilizes a solenoid 46 to open or close the valve element, thus making or sealing an opening 48 in the septum.

It can be seen from FIG. 6 that by virture of the switches 50 above the solenoids 38 that should either one of the solenoids 38, or both of them, be actuated, the bypass valve 44 would not be operated and thus the integrity of the septum would be intact. If, however, neither of the solenoids 38 are energized, that is if only solenoids 36 are operated which occurs during the eight cylinder mode of operation, both of switches 50 will be closed, energizing the solenoid 46 to open the valve to provide the hole in the septum. This permits equalization of pressure from the right chamber to the left during eight cylinder operation. It is also possible to operate on eight cylinders without the bypass valve being opened by depressing the bypass toggle switch 52.

Another feature of the embodiment of FIG. 6 is the automatic eight cylinder operation provided by use of the accelerator switch 54 which is actuated upon flooring the accelerator. It can be seen that such action automatically powers the two solenoids 36 which are more powerful and thus overcome temporarily the solenoids 38 and energize all cylinders.

Turning now to FIG. 6, this drawing diagrammatically illustrates a control system very similar to that shown in FIG. 5 but with the difference that instead of being able to manually select the particular four cylinders that are operative at a particular time, this system automatically alternates from one to the other as the engine is started from one engine operation to the next so that the wear is more or less even.

In this embodiment, if the four cylinder switch is depressed momentarily a time delay element 56 provides a pulse to the alternating automatic selector 58. The pulse thus delivered is adequate to flip the selection contact 60 from whichever position it began in to the opposite position, taking with it the solenoid selector switch 60 which alternatively energizes one or the other of the off solenoids 38, just as in FIG. 5. If the "8" button instead is depressed, the solenoids 36 are actuated so that both cylinders are in operation.

Figure 4:
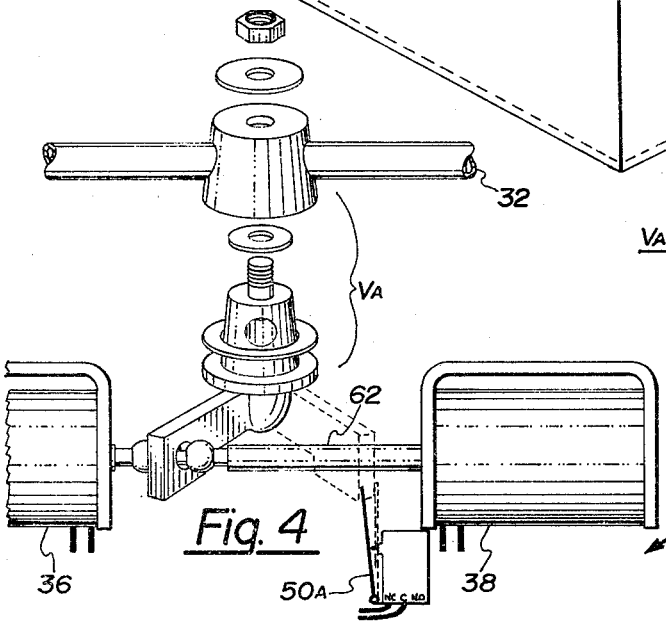
FIG. 4 is an exploded perspective of a typical fuel valve used in the fuel lines to the carburetors.

A typical physical implementation of one of the valves $V_A$ or $V_B$ is shown in FIG. 4, indicated at $V_A$. This valve is captured on a push-pull rod 62 adapted between the two solenoids 36 and 38.

In any of its three embodiments, the invention provides a simple and inexpensive way to meet the energy problem and the gasoline shortage. As a retrofit item, it is extremely important because, even though currently produced automobile models are becoming more efficient, this obviously does not affect the millions of gas consuming V-8 engines that are currently in use.

What is claimed is:

1. An engine input bifurcation apparatus for a piston engine having two fuel mixture input barrels, one of said barrels inputting to half the cylinders and the other of said barrels inputting to the other half of said cylinders, said apparatus comprising:

(a) a plenum mountable over said input barrels and having a septum dividing said plenum into a first chamber and a second chamber, each of said chambers having a mounting defined by said plenum for a carburetor separate from the carburetor of the other of said chambers and each chamber communicating with one of said input barrels only;

(b) a first carburetor mounted on said plenum operative with said first chamber and a second carburetor mounted on said plenum operative with said second chamber;

(c) each of said carburetors having separate fuel feed lines with a control valve therein;

(d) means operative to control said control valves separately to deliver fuel to either one or both of said chambers and thus to operate either half or both halves of the engine cylinders.

2. The structure according to claim 1 and including a valve opening in said septum and means to operate said valve to open same when all of the engine cylinders are operative.

3. The structure according to claim 1 wherein said piston engine is mounted in a motor vehicle, said control valves are solenoid operated, and including solenoid control switches mounted in the operating compartment of said vehicle.

4. The structure according to claim 3 and including a means to automatically alternatively select a first set of operative cylinders and the next time the engine is run the remaining cylinders will be selected to be operative, so that the wear on the cylinders will be balanced.

5. The structure according to claim 4 wherein said septum is provided with an opening valved by a solenoid valve switch controlled from within the operating compartment of the vehicle.

6. The structure according to claim 5 and including an override circumventing the automatic alternative selector means, and said override automatically opens a valved opening in said system when actuated.

* * * * *